US007065991B2

(12) United States Patent
Ferreira Vieira Leite

(10) Patent No.: US 7,065,991 B2
(45) Date of Patent: Jun. 27, 2006

(54) SAFETY LOCK FOR GLASS DOORS

(76) Inventor: António Augusto Ferreira Vieira Leite, Rua Duque da Terceira, 173-4 andar, Porto 4000-535 (PT)

( * ) Notice: Subject to any disclaimer, the term of this patent is extended or adjusted under 35 U.S.C. 154(b) by 0 days.

(21) Appl. No.: 10/507,724

(22) PCT Filed: Feb. 25, 2003

(86) PCT No.: PCT/PT03/00001

§ 371 (c)(1),
(2), (4) Date: May 27, 2005

(87) PCT Pub. No.: WO03/074824

PCT Pub. Date: Sep. 12, 2003

(65) Prior Publication Data

US 2005/0223760 A1 Oct. 13, 2005

(30) Foreign Application Priority Data

Mar. 4, 2002 (PT) ..... 9792 U

(51) Int. Cl.
*E05B 65/06* (2006.01)

(52) U.S. Cl. ..... 70/134; 70/129

(58) Field of Classification Search ..... 70/95, 70/99, 100, 129, 134
See application file for complete search history.

(56) References Cited

U.S. PATENT DOCUMENTS 304,041 A * 8/1884 Sparks ..... 70/100

(Continued)

FOREIGN PATENT DOCUMENTS

EP 0 297 465 1/1989

(Continued)

*Primary Examiner*—Suzanne Dino Barrett
(74) *Attorney, Agent, or Firm*—Oblon, Spivak, McClelland, Maier & Neustadt, P.C.

(57) ABSTRACT

The present invention refers to a safety lock for glass doors with a standard cut. This lock has two covers (1 and 9) and a strike plate (13), defining an internal space, inside which it is the lock mechanism of reduce dimensions, where the Hungarian type lock cylinder (11) is firmly attached. The lock mechanism is comprised by part of the base cover (1), which perpendicular walls to the base form a substantially rectangular box, having two crenellated parallel walls and perpendicular to the strike plate (13). Inside this box is arranged an internal mechanism comprised by a grooved lower plate (2), a locking plate (3), a pin (4), a spring (5) and a grooved upper plate (7) the grooves in the lower and upper plates being matched one another. The locking plate (3) has in one tip a shaft and one teeth formation in the external periphery the spring (5) being fitted into a recess in the locking plate (3), adjacent to the place where is fixed the pin (4) which is used for securing the locking plate (3) in the lower and upper plates (2, 7) of the internal mechanism.

4 Claims, 7 Drawing Sheets

U.S. PATENT DOCUMENTS

| | | | | | |
|---|---|---|---|---|---|
| 504,292 | A | * | 8/1893 | Badoni | 70/448 |
| 913,459 | A | * | 2/1909 | Bily | 70/355 |
| 1,374,616 | A | * | 4/1921 | Andor | 70/134 |
| 1,639,144 | A | * | 8/1927 | Muzzio | 70/380 |
| 1,756,342 | A | * | 4/1930 | Joseph | 70/134 |
| 1,864,429 | A | * | 6/1932 | Will et al | 70/134 |
| 2,327,071 | A | * | 8/1943 | Schlage | 70/129 |
| 4,593,542 | A | * | 6/1986 | Rotondi et al. | 70/134 |
| 4,656,849 | A | * | 4/1987 | Rotondi et al. | 70/134 |
| 4,739,638 | A | * | 4/1988 | Lin | 70/129 |
| 5,009,089 | A | * | 4/1991 | Lin | 70/114 |
| 5,058,940 | A | * | 10/1991 | Hart | 292/167 |

FOREIGN PATENT DOCUMENTS

| | | |
|---|---|---|
| GB | 2 210 656 | 6/1989 |

* cited by examiner

SAFETY LOCK FOR GLASS DOORS

BACKGROUND OF THE INVENTION

Field of the Invention

The present invention concerns a safety lock especially for glass doors having a standard cut, which is simpler than the existent locks. The lock according present invention although is designed for glass doors but can have other applications in association with different suitable covers.

The invention concerns a special construction of a lock mechanism, which allows a reduction of the space occupied by the same, and the possibility of more than one turn of the lock cylinder.

DISCUSSION OF THE BACKGROUND

Locks for glass doors are well known in the art and used all over the world, so the difficulties presented by this type of locks when applied to toughened glass doors with a standard cut having a thickness ranging from 8 to 12 mm are known. This cut is of reduced dimensions, which reduces drastically the size of the lock, not allowing the use in this kind of lock of a Hungarian type lock cylinder.

SUMMARY OF THE INVENTION

The object of the present invention is a safety lock for glass doors made of toughened glass. The safety lock according to the invention is applicable particularly to glass doors with a standard cut having a thickness ranging from 8 to 12 mm. This safety lock may also have other applications. The safety lock according to the invention has reduced width and height dimensions, and can be associated with any kind of lock cylinder, for example, a Hungarian type lock cylinder.

The safety lock according to the invention comprises case means having two covers and one strike plate, which defines an internal space, inside which is the lock mechanism and the lock cylinder. The lock mechanism comprises fixed locking means, which comprises a box associated with one of said covers preferably of quadrangular shape limited by a wall having a suitable thickness. The box has preferably a quadrangular section with at least a rectilinear crenellated formation, and preferably the box has two parallel walls with crenellated formations and internal locking means, which is coupled to the driven means through a drag means, linked to the lock cylinder means. The driven means is driven forward and unlocking the said internal locking means, is made by their rotation around a shaft, which is disposed in its periphery and by pressure of spring means which is adjacent to the shaft. The bolt means are associated with said driven means and are moved forward or backward synchronized with the said driven means. The use of these new means, allows the use of any lock cylinder means, for example of Hungarian type, enabling then the use of master keys, further enabling the use in doors opening either from the right or from the left, all one has to do is to reverse the internal mechanism. Finally, these means offer a high level of security and reliability because they are totally inside the lock and the lock cylinder means being protected by said case means.

For a better understanding an embodiment of the invention will be disclosed in detail as a non-limitative example illustrated in the appended drawings, in which.

Figure 1:
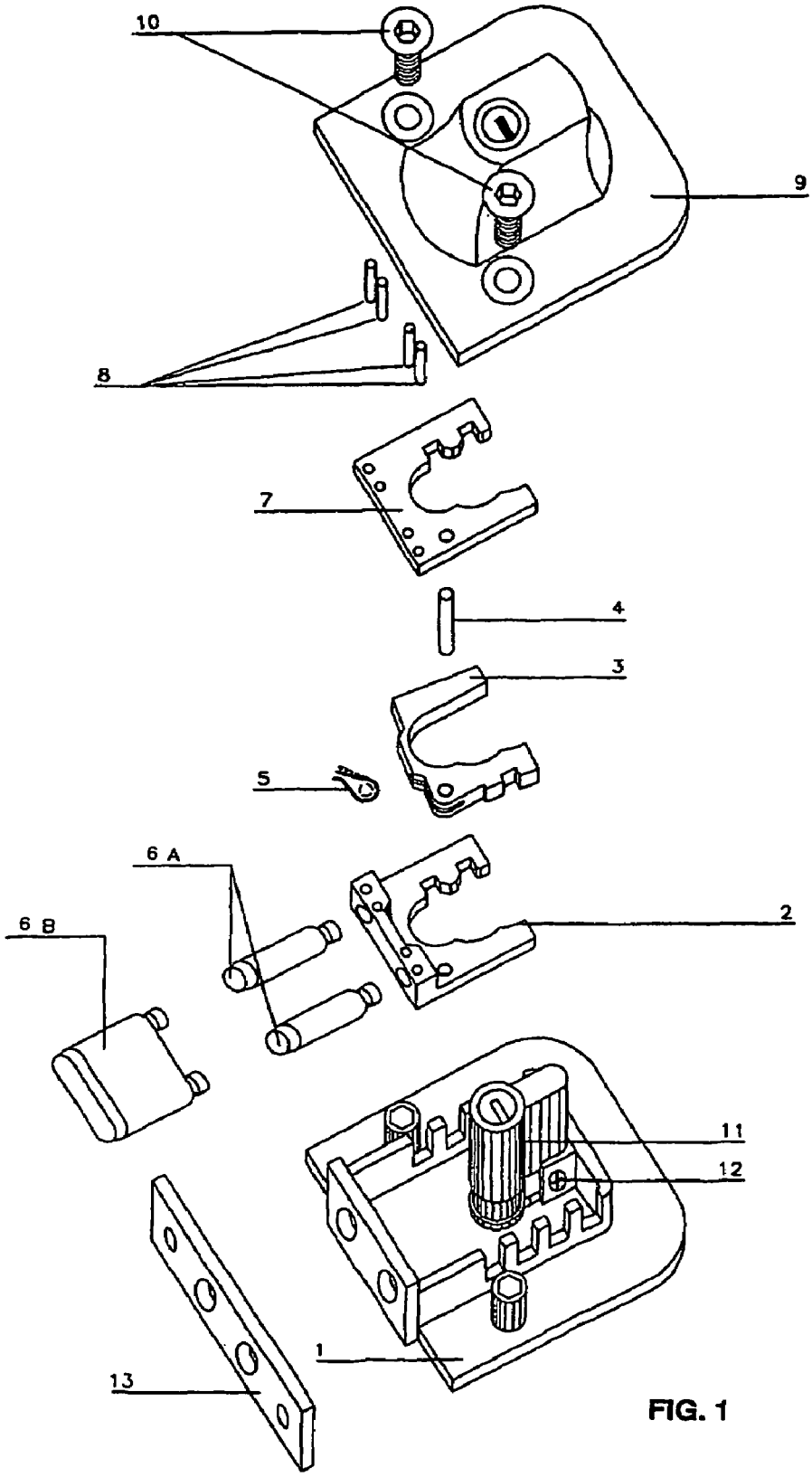
FIG. 1 is a exploded perspective view of the lock, according to the present invention.
Figure 2:
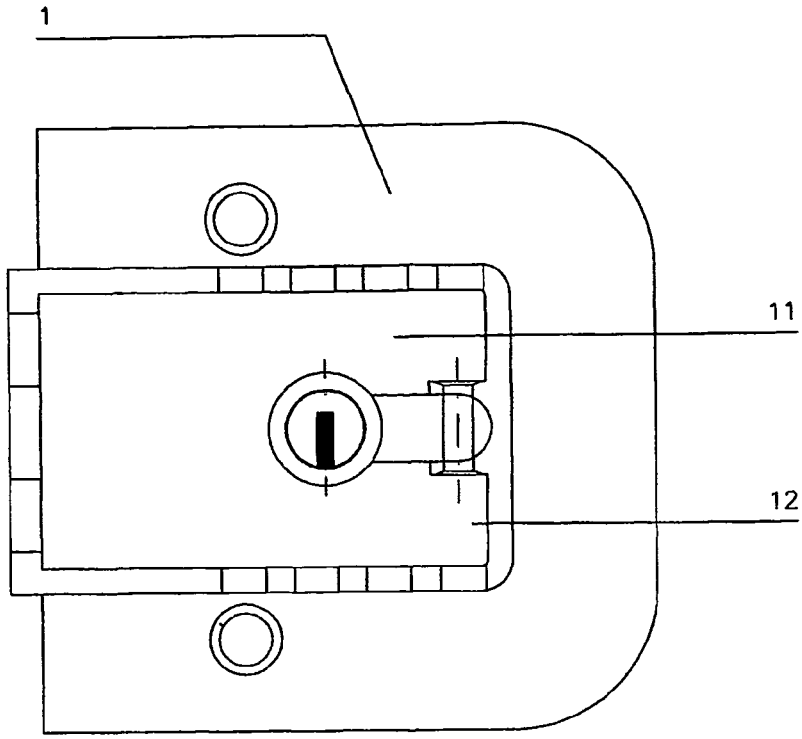
FIG. 2 is a lateral elevation view of the lock base plate with the fixed lock cylinder.
Figure 3:
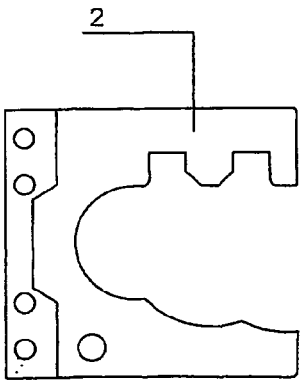
FIG. 3 is a lateral elevation view of the internal mechanism lower plate.
Figure 4:
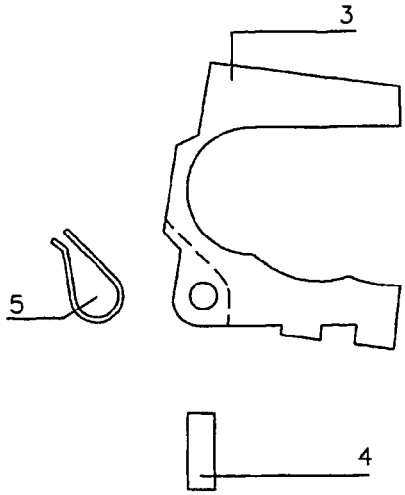
FIG. 4 is a lateral elevation view of the lock plate, the associated spring and the retaining pin of the lock plate.
Figure 5:
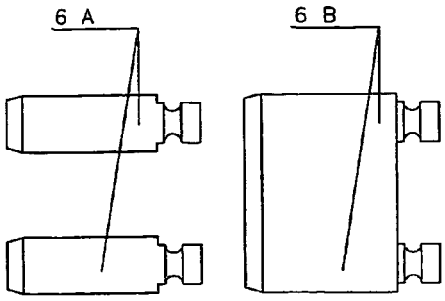
FIG. 5 shows two types lock bolts: rods and bolts.
Figure 6:
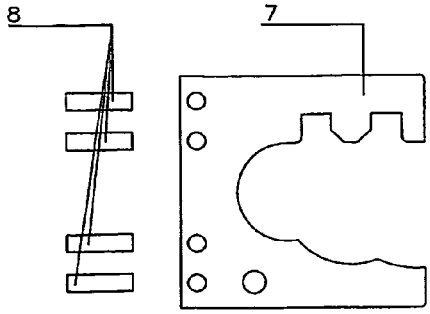
FIG. 6 is a lateral elevation view of the internal mechanism upper plate also being shown the retention pins into the lower plate.
Figure 7:
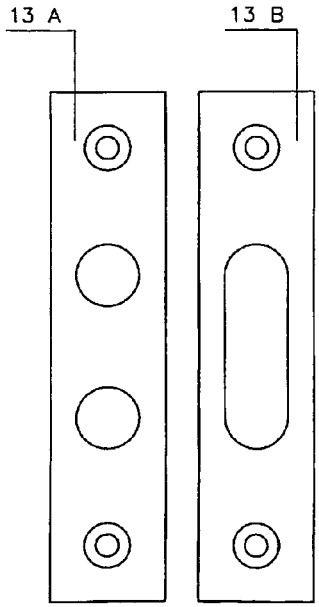
FIG. 7 is a frontal view of the strike plate of the lock.
Figure 8:
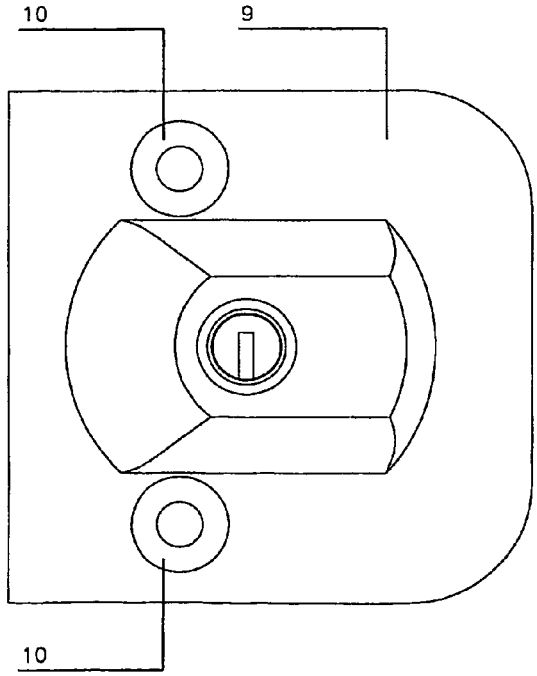
FIG. 8 is a frontal view of the lock cover showing the attaching screws.

In the FIG. 1 is represented an embodiment of the safety lock according the present invention, intended for use in glass doors with a standard cut having a thickness ranging from 8 to 12 mm. The lock has two covers 1 and 9 and one strike plate 13 defining an internal space inside which it is the lock mechanism of reduce dimensions, where the Hungarian type lock cylinder 11 is firmly attached by two screws 12. The lock mechanism is comprised by part of the base cover 1, which perpendicular walls to the base form a substantially rectangular box, having two crenellated parallel walls and perpendicular to the strike plate 13. Inside this box is arranged an internal mechanism comprised by a grooved lower plate 2, a locking plate 3, a pin 4, a spring 5 and a grooved upper plate 7 the grooves in the lower and upper plates being matched one another. Associated with the said plates 2 and 7 through the retaining pins 8, is placed a lock bolt 6 which can have two rods. The lock cover 9 is attached to the base cover 1 and to the lock strike plate 13 by the screws 10. The locking plate 3 has in one tip a shaft and one teeth formation in the external periphery the spring 5 being fitted into a recess in the locking plate 3, adjacent to the place where is fixed the pin 4 which is used for securing the locking plate 3 in the lower and upper plates 2, 7 of the internal mechanism. This pin is the shaft of the locking plate 3 and matches with the spring 5 axis.

Figure 14:
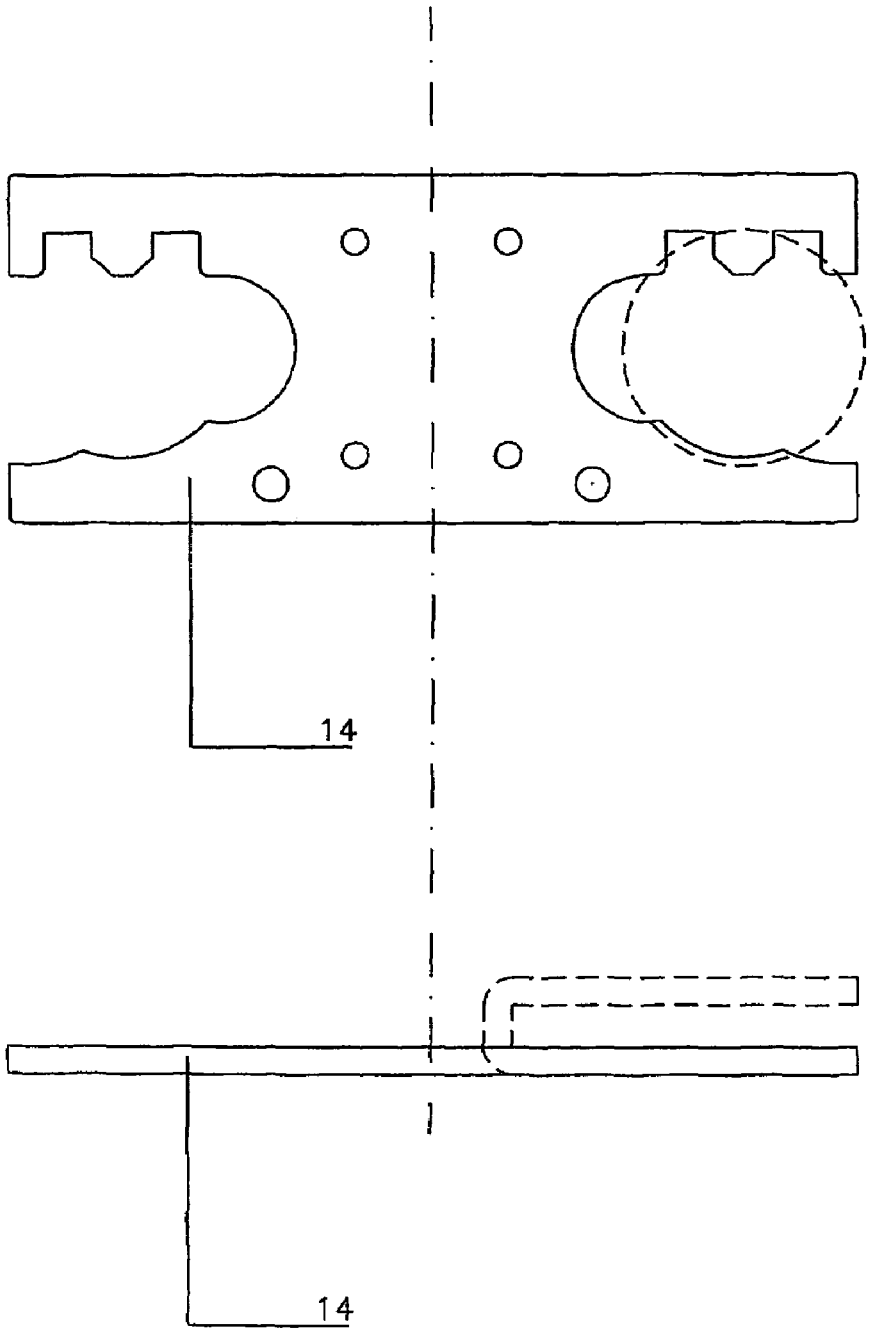
FIG. 14 is a frontal view and a lateral view of a further embodiment of the lock mechanism upper and lower plates merged in a single piece.

In FIG. 14 is shown further embodiment of the internal mechanism, in which the lower and upper plates 2, 7 were merged in a single piece.

Figure 9:
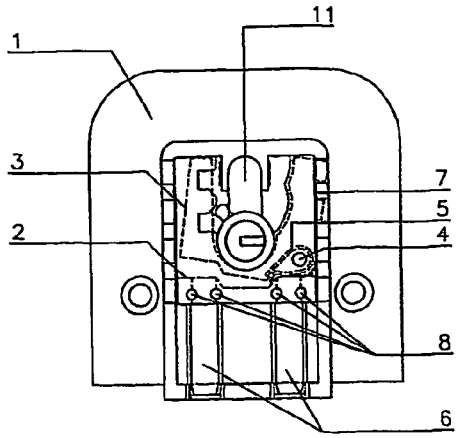
FIG. 9 is a lateral elevation view of the lock mechanism in the open condition.
Figure 10:
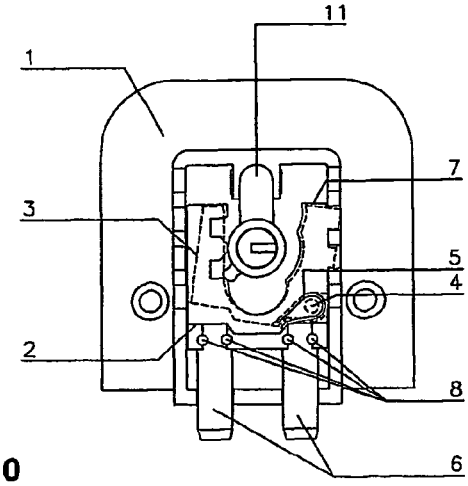
FIG. 10 is a lateral elevation view of the lock mechanism in the intermediated lock condition, after a first turn of the lock cylinder.

When the drag piece of the lock cylinder 11 is turned, it drives the locking plate 3, taking off its teeth from the crenellated formation of said box, releasing it from the first locked position (FIG. 9), and engages into the first grooves of lower 2 and upper 7 plates of the internal mechanism, displacing it with the associated lock bolt 6A or 6B (FIG. 10) of a first distance, the locking plate 3 being locked through the pressure of the spring 5 in its second position (FIG. 10), just when the lock drag piece cease acting on said locking plate 3.

Figure 11:
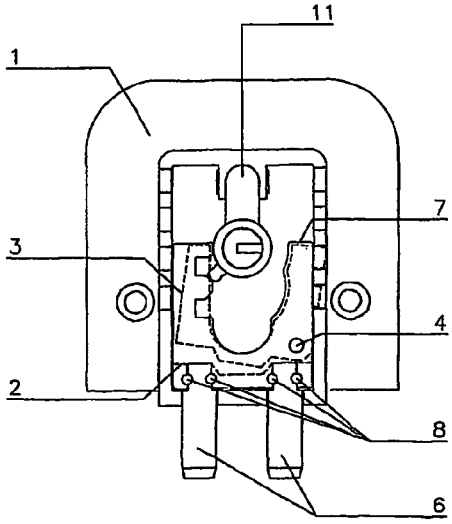
FIG. 11 is a lateral elevation view of the lock mechanism in the final lock condition, after a second turn of the lock cylinder.
Figure 12:
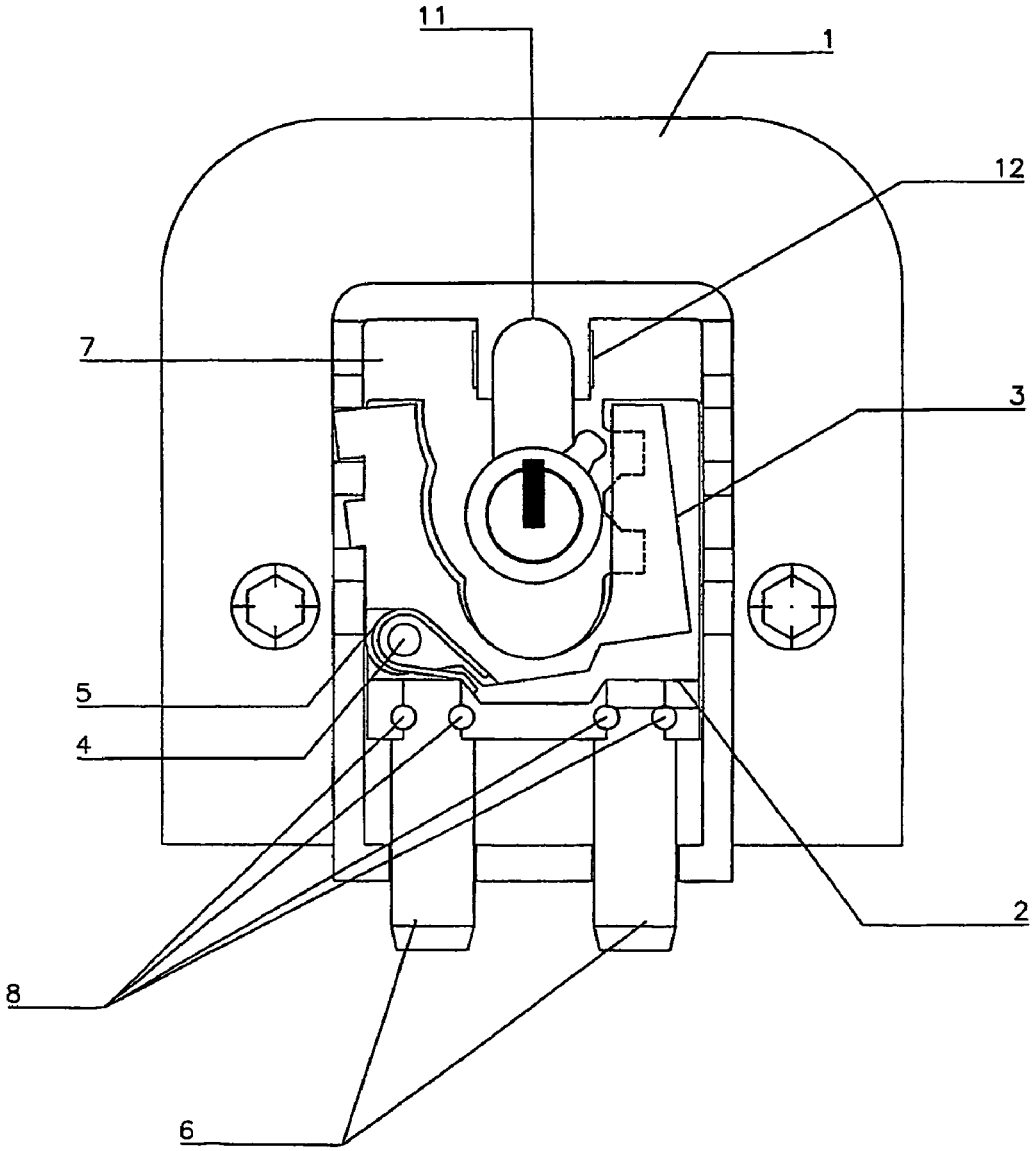
FIG. 12 is a lateral elevation view with the internal mechanism reversed.
Figure 13:
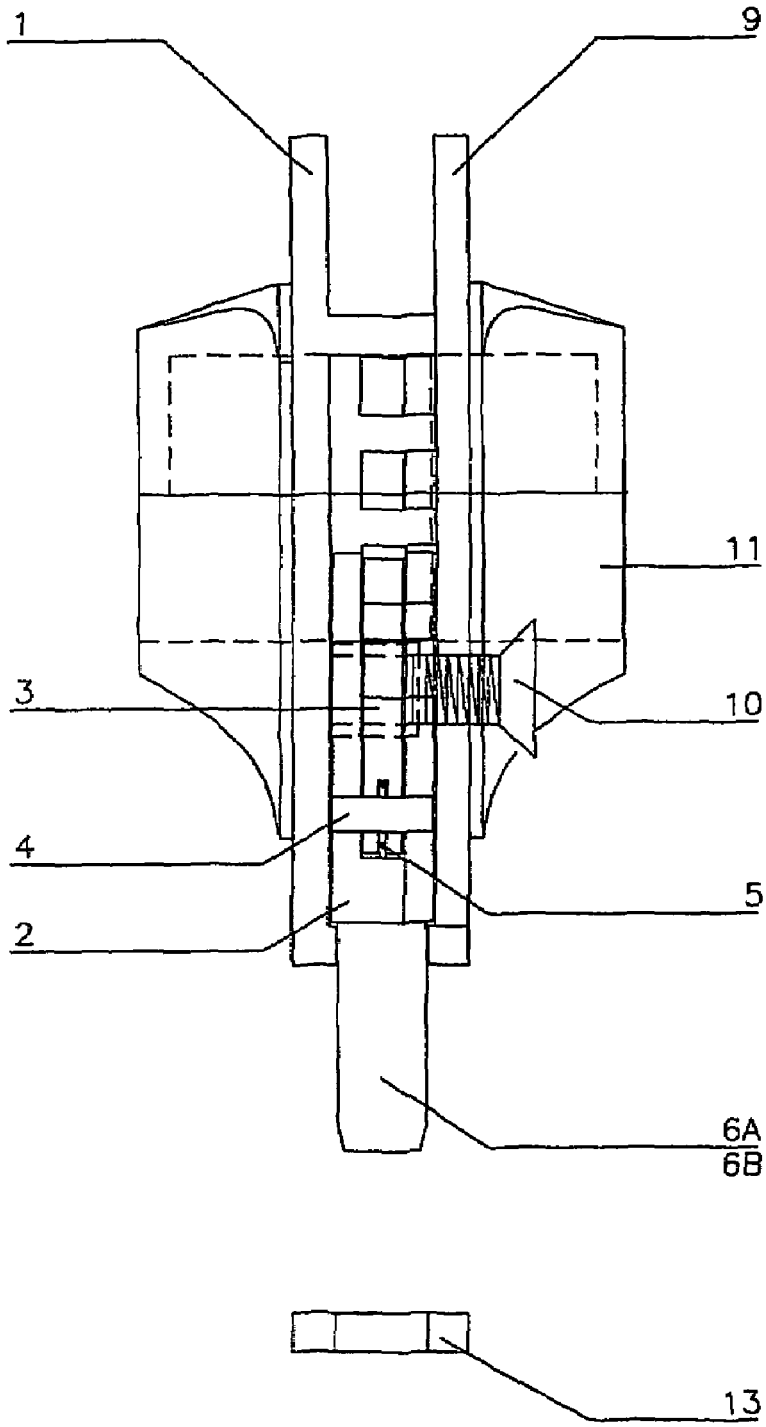
FIG. 13 is (longitudinal) top view of the installation of the lock on a glass door.

Repeating the turning movement of the cylinder 11 once more, its drag piece drives again on said locking plate 3, releasing it from the second locking position (FIG. 10), and engages it into the second grooves of internal mechanism lower and upper plates 2, 7, moving the said internal mechanism with the associated lock bolt 6A or 6B (FIG. 11) of a second distance, said locking plate 3 being locked again, by the pressure of the spring 5 in the third position (FIG. 11), when said drag piece cease driving on said locking plate 3, which releases the internal mechanism 2, 3, 4, 5, 6, 7 and 8 and is the action of said spring 5 on said locking plate 3 that locks the internal mechanism 2, 3, 4, 5, 6, 7 and 8 in all its conditions: the open condition (FIG. 9), the intermediate lock condition after the first turn (FIG. 10) and the final lock condition after the second turn (FIG. 12).

This lock is different from the others, because the locking plate 3 is driven on its inner periphery and locks through its outer periphery.

The said cover 9 (FIG. 1) has a special shape in order to house inside it said lock cylinder 11.

This present invention lock can work in doors that open either from the right (FIG. 12) or from left (FIG. 9), being sufficient to reverse its internal mechanism (2, 3, 4, 5, 6, 7 and 8), cf. FIG. 12.

The invention claimed is:

1. A safety lock for doors, comprising:

a base cover, a lock cover and one strike plate, the said base cover and lock cover defining an inner space, the base cover being attached the lock cover by securing members;

a lock mechanism located in said inner spaces and including a lock cylinder which comprises a drag piece;

wherein said lock mechanism further comprises:

a portion of the base cover, and walls perpendicular to said base cover which together form a substantially rectangular box, having two parallel side walls with crenellations, said side walls being perpendicular to said strike plate;

an internal mechanism which comprises a grooved lower plate, a locking plate, a pin, a spring having a wire loop shape, and a grooved upper plate, the grooves in the lower and upper plates being matched to each other, wherein said internal mechanism is positioned inside said rectangular box and wherein holes are provided in the lower and upper plate;

a plurality of retaining pins;

a lock bolt attached to the lower and upper plates via the retaining pins; the locking plate having a side hole within which the pin is housed wherein a teeth formation is formed on the external periphery thereof, the spring being fitted into a recess of the locking palate adjacent to the pin, the pin being housed within the holes in the lower and upper plate;

said pin forming an axis of said spring and for the rotation shaft for said locking plate, said locking plate being disposed between said lower and upper plates and being connected to the lower and upper plates by said pin;

wherein said locking plate is driven by said drag piece of said lock cylinder on an internal periphery thereof and which locks through the teeth on the outer periphery thereof in the crenellations of one of said parallel side walls; and wherein the action of said drag piece of the cylinder on said locking plate releases said internal mechanism and, under the pressure of said spring on the locking plate, locks the inner mechanism in the crenellations of one of said parallel side walls in all positions thereof including, a first locking position, a second locked position after the first turn and a third locked position after the second turn.

2. The safety lock of claim 1, wherein the said safety lock is adapted for use with doors that open either from the right or from left for which is sufficient to reverse its internal mechanism.

3. The safety lock of any previous claim, wherein said lower and upper plates comprise a single piece.

4. The safety lock of any previous claim, wherein said lock cylinder comprises a Hungarian type lock cylinder.

* * * * *